US006582315B1

(12) United States Patent
Formanski

(10) Patent No.: US 6,582,315 B1
(45) Date of Patent: Jun. 24, 2003

(54) SELF CONTAINED WATER SLIDE FOR INDIVIDUAL YARD USE

(76) Inventor: Joseph J. Formanski, 15130 Auburn Rd., Newbury, OH (US) 44065

( * ) Notice: Subject to any disclaimer, the term of this patent is extended or adjusted under 35 U.S.C. 154(b) by 0 days.

(21) Appl. No.: 10/036,555

(22) Filed: Dec. 31, 2001

(51) Int. Cl.[7] ..... A63G 21/18
(52) U.S. Cl. ..... 472/117; 472/116; 4/494
(58) Field of Search ..... 472/116, 117, 472/128, 89, 90, 88; 104/53, 69, 70; 4/488, 494, 509

(56) References Cited

U.S. PATENT DOCUMENTS 3,690,265 A * 9/1972 Horibata et al. ..... 104/70
4,484,739 A * 11/1984 Kreinbihl et al. ..... 104/70
4,805,898 A * 2/1989 Jacober et al. ..... 104/70
5,478,281 A * 12/1995 Forton ..... 472/116
5,540,622 A 7/1996 Gold et al.
5,551,922 A 9/1996 Katz et al.
5,728,005 A 3/1998 Rothbard
5,779,553 A * 7/1998 Langford ..... 104/73
5,865,679 A 2/1999 Seabolt et al.
6,062,983 A 5/2000 Butsook
6,146,282 A 11/2000 McCready et al.
6,186,902 B1 2/2001 Briggs

* cited by examiner

*Primary Examiner*—Kien T. Nguyen
(74) *Attorney, Agent, or Firm*—John D. Gugliotta; Olen L. York, III

(57) ABSTRACT

A plastic slide is provided with a pump at the bottom of the slide and placed into a pool, typically a wading pool. A strainer assembly filters out grass and other foreign matter from the water, and transfers the water through a small electrical, air, or battery powered pump to the top of the slide, where the water is released. The water then falls down the slide and back into the pool where it repeats the cycle as long as the pump is energized.

19 Claims, 4 Drawing Sheets

SELF CONTAINED WATER SLIDE FOR INDIVIDUAL YARD USE

RELATED APPLICATIONS

The present invention was first described in Disclosure Document Number 498,716 filed on Aug. 20, 2001 under 35U.S.C. §122 and 37 C.F.R. §1.14. There are no previously filed, nor currently any co-pending applications, anywhere in the world.

BACKGROUND OF THE INVENTION

1. Field of the Invention

The present invention relates generally to water recreation devices and, more particularly, to an apparatus that provides an individual water slide using a new or existing converted slide that contains and circulates its own water supply.

2. Description of the Related Art

Very few play time activities rival that of spending a hot summer day playing in water. Whether it is a large, in-ground, Olympic size pool, a small backyard pool, or even a garden hose and a sprinkler, the fun of water combined with its cooling properties, make water an attraction that few people, especially children, can resist. One type of water attraction, commonly found at water parks, but usually not in backyards is that of the water slide. While some creative children may take a garden hose and put it at the top of the slide, it quickly creates a muddy mess, not to mention a high water bill or concern over water usage for those having water supplied by a well.

A search of the prior art did not disclose any patents that read directly on the claims of the instant invention; however, the following references were considered related:

| U.S. Pat. No. | Inventor | Issue Date |
|---|---|---|
| 6,186,902 | Briggs | Feb. 13, 2001 |
| 6,146,282 | McCready et al. | Nov. 14, 2000 |
| 5,865,679 | Seabot et al. | Feb. 2, 1999 |
| 5,551,922 | Katz et al. | Sep. 3, 1996 |
| 5,540,622 | Gold et al. | Jul. 30, 1996 |
| 5,728,005 | Rothbard | Mar. 17, 1998 |
| 6,062,983 | Butsook | May 16, 2000 |

Of considerable relevance are the McCreary et al and Seabolt et al. disclosures. While these reference provide for water slides have features that are incorporated into this invention in combination, other elements are different enough as to make the a self contained water slide for individual yard use distinguished over this or other art.

Consequently, a need has been felt for a means by which the fun of a backyard water slide can be provided the features of a commercial water park within an individual use's own property.

SUMMARY OF THE INVENTION

It is therefore an object of the present invention to provide an improved water recreation device.

It is a feature of the present invention to provide an improved apparatus is provided that converts a standard backyard slide into a water slide.

Briefly described according to one embodiment of the present invention, an apparatus is provided that converts or provides a backyard slide into a water slide for use with a wading pool. The invention is used with a plastic slide that is typically found as part of a backyard swing set or by itself. The bottom of the slide is placed into a pool, typically a wading pool, and the pool is filled with water. Next, a strainer assembly filters out grass and other foreign matter from the water, and transfers the water through a small electrical, air, or battery powered pump to the top of the slide, where the water is released. The water then falls down the slide and back into the pool where it repeats the cycle as long as the pump is energized. The invention provides almost unlimited fun without wasting of water or creating a muddy mess.

In accordance with a preferred embodiment, a water slide is provided that converts backyard slide and pool into a new fun toy.

An advantage of the use of a strainer assembly allows for filtering of grass and other foreign matter out of the water. This keeps the pump from clogging up and can be easily cleaned after each use.

Another advantage is the use of a pump powered by a motor that keeps recirculating water, which saves on water bill by conserving when compared to a continuously running hose and prevents overfilling pool and associated ponding. An additional alternate advantage is to allow for conservation of water for those using a well.

Further, various configurations can be sold with slide and/or pool, or the pump, strainer, and hoses can be sold separately as a kit to convert existing pools and slides. This allows pool and slide to return to their regular usage without alteration.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
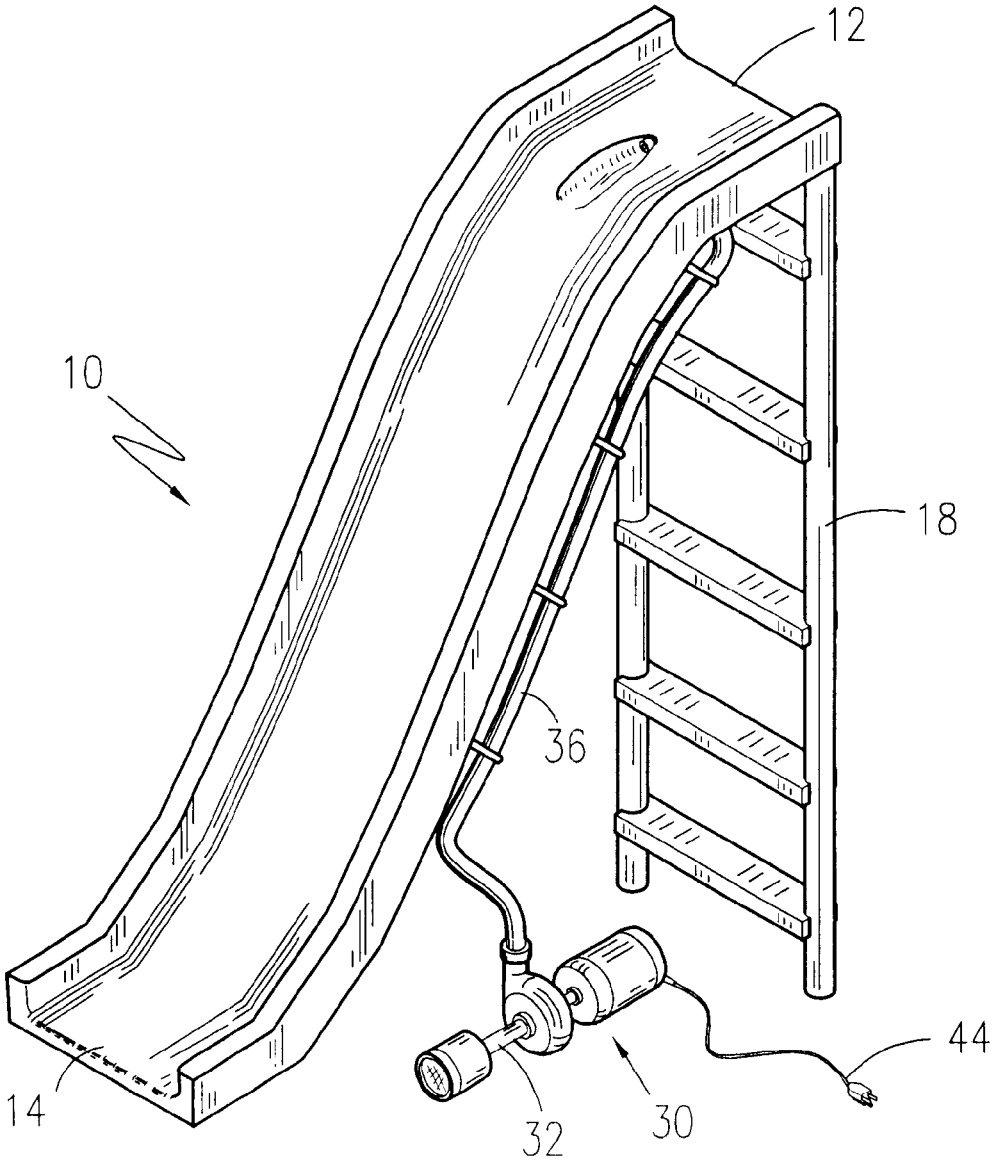
FIG. 1 is a perspective view of a personal water slide according to the preferred embodiment of the present invention.
Figure 2:
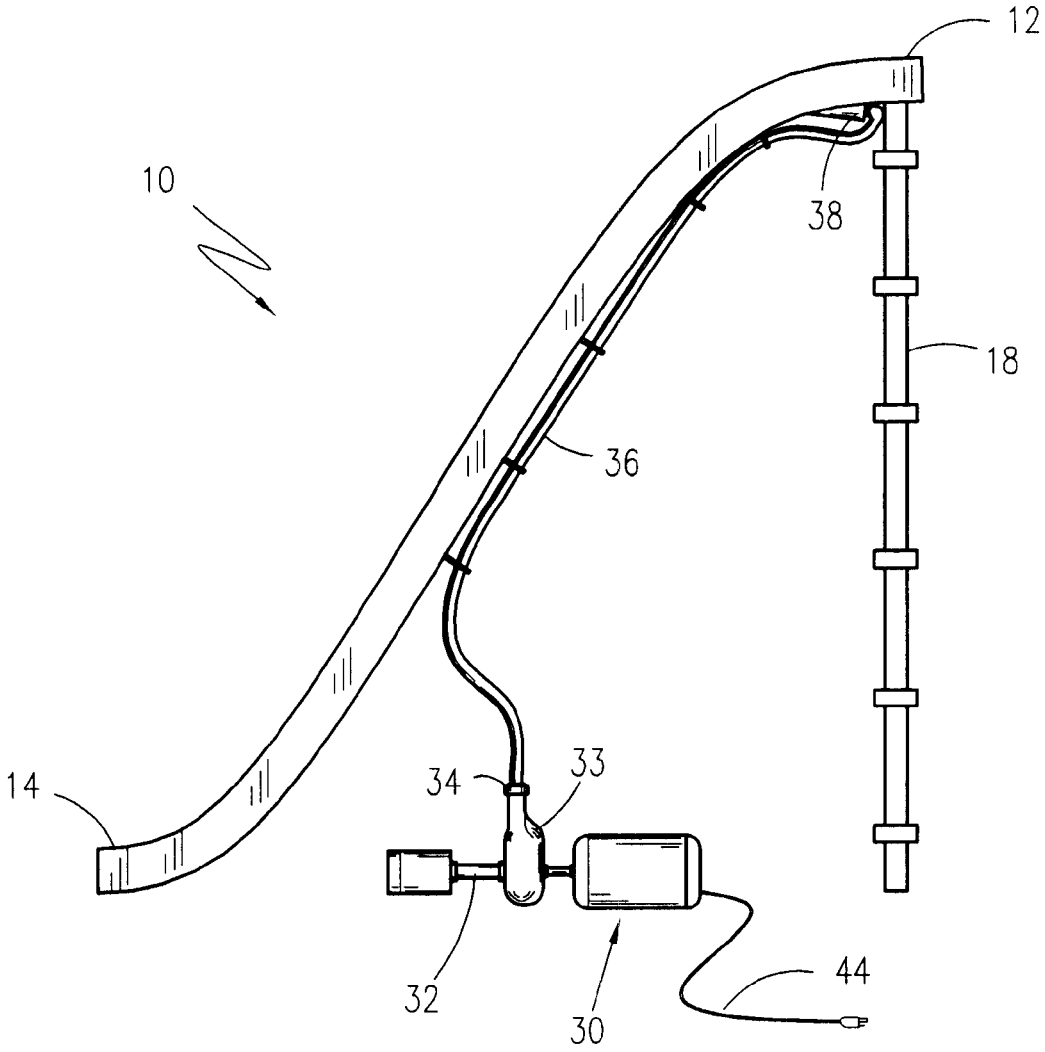
FIG. 2 is a side elevational view thereof.

Referring now to FIGS. 1–2, a personal water slide 10 is shown, according to the present invention, that is specifically adapted as a self contained water slide for individual yard use. As such, the slide 10 has an upper end 12 vertically above a lower end 14 opposite a flat upper slide surface 16 (see FIG. 5). A ladder 18 affixed to the upper end 12 provides for access in an otherwise conventional manner. A water pump 30, as described in greater detail below, has an intake conduit 32 opposite a discharge 33. The discharge 33 forms a first conduit connection means 34 for removably affixing to a communication conduit 36. In its preferred embodiment it is anticipated that the communication conduit 36 would comprise a length of otherwise conventionally available hose. As such, the first conduit connection means 34 would comprise a male threaded hose connection. It is anticipated, however, that the communication conduit 36 could be formed in an alternate manner, either as an attached member or formed integrally into the slide 10. Formed at the upper end 12 in a manner shown in greater detail below is a second conduit connection means 38. In its preferred embodiment the second conduit connection means 38 forms a female threaded hose connection for threadingly receiving the communication conduit 36.

Figure 3:
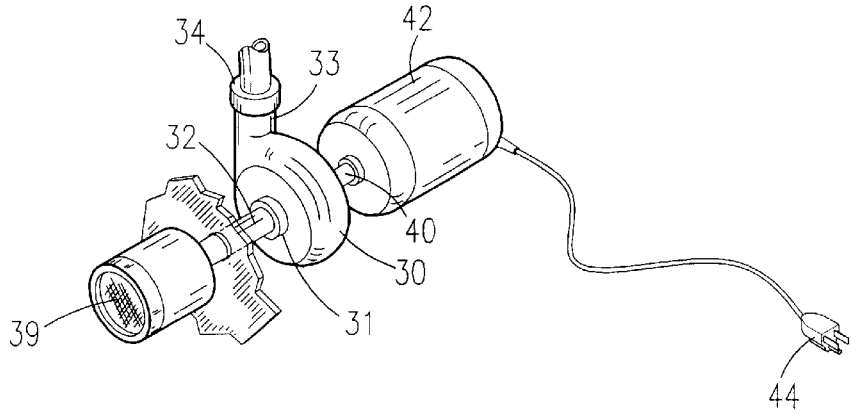
FIG. 3 is an exploded partial perspective view of a pump 30 for use therewith.

Referring now to FIG. 3, the pump 30 is shown in greater detail. The pump 30 is anticipated as being of a submersible, self priming type. The discharge 33 provides a high pressure output in fluid communication from the low pressure intake 31. The intake 31 is in fluid communication with the intake conduit 32. A strainer 39 or other filtering means envelops an intake orifice of the intake conduit 32, and thereby prevents introduction of rocks, stones, or other foreign objects into the pump 30 that would otherwise damage its operation. The intake conduit 32 is anticipated as penetrating a pool sidewall or otherwise communicating pool liquid to the pump 30 or submersed as described in greater detail below.

Further, the pump 30 is connected by a linkage 40 to a drive motor 42 that is powered by an electrical supply means 44 such as to power the pump 30. Such an electrical supply means 44 can include a long, water-tight power cord that may include an on/off switch for controlling the electrical power.

Figure 4:
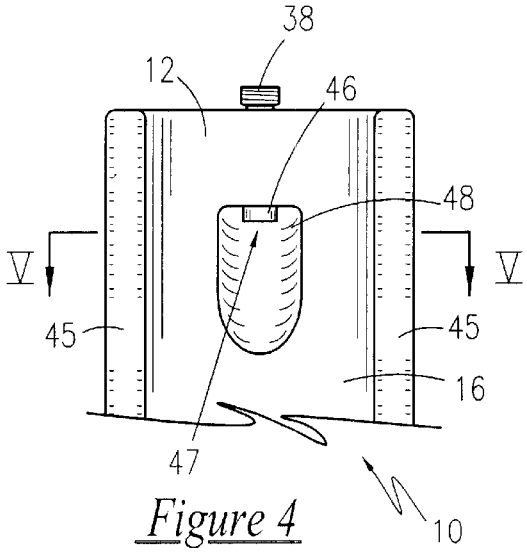
FIG. 4 is a top plan view of the upper end 12 of the present invention.
Figure 5:
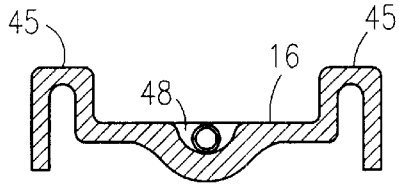
FIG. 5 is a cross sectional elevation taken along line V—V of FIG. 4.

Referring now to FIGS. 4–5, the upper end 12 is shown in greater detail. The flat upper slide surface 16 is parallelly bound by a pair of raised side rails 45. The female threaded hose coupling 38 is in fluid communication with a discharge nozzle 46 forming a discharge orifice 47 within a recess 48 beneath the flat upper slide surface 16. This assembly hereby forms a water discharge means for providing a steady flow of water from the pump and down the slide.

Figure 6A:
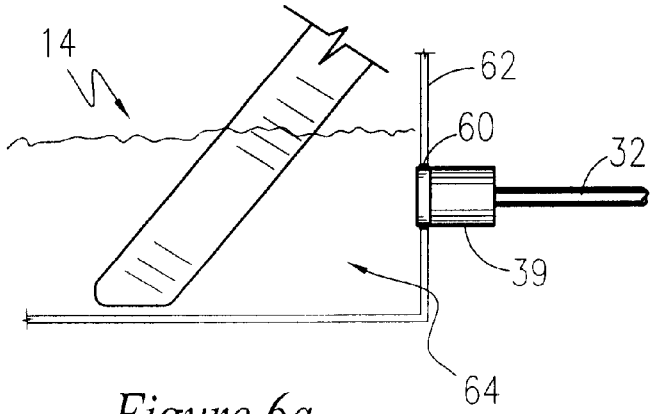
FIG. 6*a* is a partial elevation of the lower end 14 according to a preferred embodiment.

Referring to FIG. 6*a*, the lower end 14 of the present invention shows the preferred embodiment of supplying water to the pump intake. In this manner, a pool sidewall penetration 60 formed within a pool sidewall 62 provides for the strainer 39 to fittingly assemble therein, providing a fluid path to the pool water 64. In this manner, the lower end 14 of the slide 10 can rest separately on the bottom of the pool.

Figure 6B:
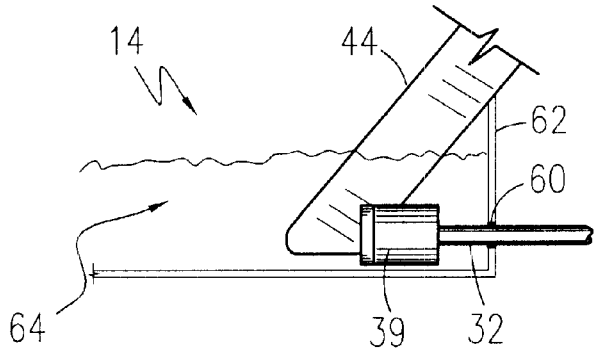
FIG. 6*b* is a partial elevation of the lower end 14 according to a first alternate embodiment.

Referring to FIG. 6*b*, an alternate configuration is shown in which the strainer 39 is fully located and submerged within the pool water 64, and only the intake conduit 32 translates through a pool sidewall penetration 60. One advantage of such a configuration is the anticipated physical connection of the pool sidewall 62 to the slide 10 or side rail 45.

Figure 6C:
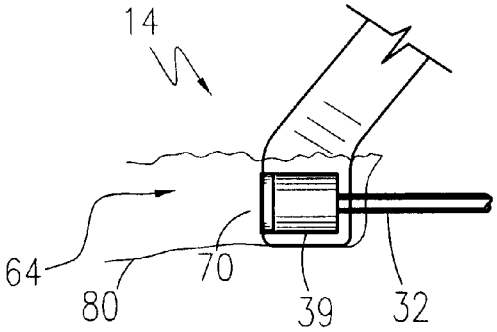
FIG. 6*c* is a partial elevation of the lower end 14 according to a second alternate embodiment.

Referring finally to FIG. 6*c*, a second alternate configuration is shown in which the strainer 39 is formed integrally into the lower end 14 of the slide 10, thereby forming a suction orifice 70 integrally at the bottom of the slide. An advantage of this configuration is the anticipated lack of modifications to the pool sidewall, thereby allowing use with many conventionally available portable pools. Similarly, such a configuration, with the addition of a fluid reservoir 80 fluid receiving reservoir for collecting liquid draining from the slide would allow for free-standing use without the need for a pool at all.

2. Operation of the Preferred Embodiment

The use of the personal water slide takes two common backyard toys and combines them together to make an even more fun toy, in a manner which is quick, easy, safe and effective. To use the present invention, the communication conduit is connected between the pump and discharge nozzle, and turned on. Fluid from the pool will then be drawn up to the top of the slide and discharged down the slide surface, providing for a self contained water slide for individual yard use.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. By way of example, but not as a limitation, the present disclosure anticipates that by shutting off the water the apparatus can be used as an otherwise conventional slide; or, under the correct conditions and if facilities permit, a indoor water slide can also be configured. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A personal water slide specifically adapted as a self contained water slide for individual yard use comprising:

a slide having an upper end vertically above a lower end opposite a flat upper slide surface;

a ladder affixed to said upper end for providing access to said upper slide surface;

a water pump having an intake conduit opposite a discharge, said discharge forming a first conduit connection means;

a communication conduit removably affixable to said first conduit connection means;

second conduit connection means formed at said upper end; and a strainer integrally formed into the lower end of the slide, thereby forming a suction orifice integrally at the bottom of the slide.

2. The water slide of claim 1, wherein said communication conduit comprises a length of flexible sidewall hose formed integrally into a side rail of said slide.

3. The water slide of claim 1, wherein said first conduit connection means comprises a male threaded hose connection.

4. The water slide of claim 1, wherein said second conduit connection means forms a female threaded hose connection for threadingly receiving said communication conduit.

5. The water slide of claim 4, wherein said female threaded hose coupling is in fluid communication with a discharge nozzle forming a discharge orifice within a recess beneath the flat upper slide surface.

6. The water slide of claim 1, further comprising filtering means that envelops an intake orifice of said intake conduit and thereby prevents introduction of particulates into said pump.

7. A personal water slide specifically adapted as a self contained water slide for individual yard use comprising:

a slide having an upper end vertically above a lower end opposite a flat upper slide surface;

a ladder affixed to said upper end for providing access to said upper slide surface;

a water pump having an intake conduit opposite a discharge, said discharge forming a first conduit connection means, wherein said intake conduit penetrates a pool sidewall such as to communicate pool liquid to said pump;

a communication conduit removably affixable to said first conduit connection means; and second conduit connection means formed at said upper end.

8. The water slide of claim 7, wherein said communication conduit comprises a length of flexible sidewall hose formed integrally into a side rail of said slide.

9. The water slide of claim 7, wherein said first conduit connection means comprises a male threaded hose connection.

10. The water slide of claim 7, wherein said second conduit connection means forms a female threaded hose connection for threadingly receiving said communication conduit, said female threaded hose coupling in fluid communication with a discharge nozzle forming a discharge orifice within a recess beneath the flat upper slide surface.

11. The water slide of claim 7, further comprising filtering means that envelops an intake orifice of said intake conduit and thereby prevents introduction of particulates into said pump.

12. A personal water slide specifically adapted as a self contained water slide for individual yard use comprising:

a slide having an upper end vertically above a lower end opposite a flat upper slide surface;

a ladder affixed to said upper end for providing access to said upper slide surface; a water pump having an intake conduit opposite a discharge, said discharge forming a first conduit connection means;

a communication conduit removably affixable to said first conduit connection means; and second conduit connection means formed at said upper end; wherein supplying water to the pump intake is accomplished by a pool sidewall penetration formed within a pool sidewall, providing a fluid path to the pool water and allowing the lower end of the slide to rest separately on the bottom of the pool.

13. A personal water slide specifically adapted as a self contained water slide for individual yard use comprising:

a slide having an upper end vertically above a lower end opposite a flat upper slide surface;

a ladder affixed to said upper end for providing access to said upper slide surface;

a water pump having an intake conduit opposite a discharge, said discharge forming a first conduit connection means;

a communication conduit removably affixable to said first conduit connection means; and second conduit connection means formed at said upper end;

wherein supply water to the pump intake is accomplished by said pump being located and submerged within the pool water, and wherein said intake conduit translates through a pool sidewall penetration.

14. A personal water slide specifically adapted as a self contained water slide for individual yard use comprising:

a slide having an upper end vertically above a lower end opposite a flat upper slide surface;

a ladder affixed to said upper end for providing access to said upper slide surface;

a water pump having an intake conduit opposite a discharge, said discharge forming a first conduit connection means, wherein said pump is of a submersible, self priming type, and wherein further said discharge provides a high pressure output in fluid communication from a the low pressure intake, said intake in fluid communication with said intake conduit;

a communication conduit removably affixable to said first conduit connection means; and second conduit connection means formed at said upper end.

15. The water slide of claim 14, wherein said communication conduit comprises a length of flexible sidewall hose formed integrally into a side rail of said slide.

16. The water slide of claim 14, wherein said first conduit connection means comprises a male threaded hose connection.

17. The water slide of claim 14, wherein said second conduit connection means forms a female threaded hose connection for threadingly receiving said communication conduit.

18. The water slide of claim 17, wherein said female threaded hose coupling is in fluid communication with a discharge nozzle forming a discharge orifice within a recess beneath the flat upper slide surface.

19. The water slide of claim 14, further comprising filtering means that envelops an intake orifice of said intake conduit and thereby prevents introduction of particulates into said pump.

* * * * *